US005748052A

United States Patent [19]

Hasegawa

[11] Patent Number: 5,748,052

[45] **Date of Patent: *May 5, 1998**

[54] NONRECIPROCAL CIRCUIT ELEMENT

[75] Inventor: Takashi Hasegawa, Nagaokakyo, Japan

[73] Assignee: Murata Manufacturing Co., Ltd., Japan

[ * ] Notice: The term of this patent shall not extend beyond the expiration date of Pat. No. 5,638,032.

[21] Appl. No.: 798,498

[22] Filed: Feb. 10, 1997

Related U.S. Application Data

[63] Continuation of Ser. No. 439,485, May 11, 1995, Pat. No. 5,638,032.

[30] Foreign Application Priority Data

May 12, 1994 [JP] Japan ..... 6-098766

[51] Int. Cl.[6] ..... H01P 1/383

[52] U.S. Cl. ..... 333/1.1; 333/24.2

[58] Field of Search ..... 333/1.1, 24.1, 333/24.2

[56] References Cited

U.S. PATENT DOCUMENTS

| | | | |
|---|---|---|---|
| 3,334,318 | 8/1967 | Nakahara et al. | 333/1.1 |
| 5,498,999 | 3/1996 | Marusawa et al. | 333/1.1 |

*Primary Examiner*—Paul Gensler

*Attorney, Agent, or Firm*—Ostrolenk, Faber, Gerb & Soffen, LLP

[57] ABSTRACT

A high-performance, small-sized nonreciprocal circuit element whose isolation characteristics are improved by making the reactances of the central electrodes uniform for every port. The circuit element may have a multilayer substrate with three ceramic sheets. Three central electrodes are formed on these sheets, respectively. The sheets are placed on top of each other so that the central electrodes make angles of 120 degrees with respect to each other. The strip widths and/or the strip spacings in the central electrodes are set separately so as to provide uniform reactances for the individual ports.

12 Claims, 5 Drawing Sheets

NONRECIPROCAL CIRCUIT ELEMENT

This is a continuation of application Ser. No. 08/439,485, filed May 11, 1995, now U.S. Pat. No. 5,638,032.

BACKGROUND OF THE INVENTION

1. Field of the Invention

The present invention relates to a nonreciprocal circuit element (e.g., an isolator or circulator) for use in a communication appliance such as a cellular telephone or mobile telephone.

2. Description of Background Art

Generally, nonreciprocal circuit elements such as isolators and circulators act to pass signals only in the transmission direction and to block propagation in the opposite direction. These nonreciprocal circuit elements are used in transmitter circuit portions of mobile communication apparatus such as cellular telephones. As these mobile communication apparatus have become smaller, there is an increasing demand for smaller and thinner nonreciprocal circuit elements.

One isolator of this kind has the structure shown in FIGS. 4 and 5. The general structure of the isolator is shown in exploded perspective view in FIG. 4. FIG. 5 is an exploded perspective view of a dielectric multilayer substrate forming a part of the isolator. In the following figures, the surfaces on which elements are mounted face downward. Those portions on which various electrodes are formed by patterning techniques are indicated by shading.

As shown in FIG. 4, this isolator comprises a lower yoke 11 having a bottom wall on which a piece of ferrite 12 is disposed. The dielectric multilayer substrate, indicated by 13, is centrally provided with a recess in which the piece of ferrite 12 is fitted so that the substrate covers the ferrite piece 12. The isolator further includes an upper yoke 15 having a permanent magnet 14 attached to its inner wall surface. The upper yoke 15 is mounted to the lower yoke 11 to form a closed magnetic circuit. The permanent magnet 14 applies a D.C. magnetic field to the ferrite piece 12. The lower yoke 11 and the upper yoke 15 are made of a magnetic metal, and their surfaces are plated with Ag or the like.

This multilayer substrate 13 is fabricated in the following manner. As shown in FIG. 5, a number of dielectric ceramic green sheets having a thickness on the order of tens of micrometers are prepared. Various electrodes are printed on the surfaces of the sheets by patterning or other techniques. These sheets are laminated, pressed against each other, and sintered together, thus forming the multilayer substrate 13. The various electrodes formed in the sheets are connected to each other at desired locations by way of through-holes or via holes.

More specifically, grounding electrodes 1, port electrodes 2*a*, 2*b*, and connecting electrodes are formed on sheets 21–26. Port electrode 2*c* is formed on sheet 51. Thus, input/output portions of the multilayer substrate 13 are formed.

Capacitive electrodes 3*a*, 3*b*, and 3*c* are formed on a sheet 32. The grounding electrodes 1 are formed on sheets 31 and 33, respectively. Matching capacitances connected to respective ends of central electrodes 4*a*, 4*b*, and 4*c* are formed by capacitances created between the capacitive electrodes 3*a*–3*c* and the grounding electrodes 1.

Central electrodes 4*a*, 4*b*, and 4*c* are formed on sheets 41, 42, and 43, respectively, such that one central electrode is formed on one respective sheet. The sheets are placed on top of each other in such a way that the central electrodes 4*a*, 4*b*, and 4*c* make an angle of 120 degrees with respect to each other. One end of each of these central electrodes is connected with the corresponding one of the port electrodes 2*a*, 2*b*, and 2*c*. The other ends are connected with the grounding electrodes 1 through via holes.

A terminal resistor R is printed or otherwise formed between the port electrode 2*c* and the grounding electrode 1 both of which are formed on the rear surface of a sheet 51. The terminal resistor R is overcoated with epoxy resin or other resin.

In the prior art isolator, the central electrodes 4*a*, 4*b*, and 4*c* connected to all the ports have the same strip width and the same strip spacing.

In the structure described above, the respective distances between the central electrodes and the lower yoke (or a grounding surface) or the upper yoke vary from port to port. Therefore, where the central electrodes around the ports are designed to have the same strip width and the same strip spacing as in the prior art techniques, the characteristic impedance of the central electrode differs from port to port. More specifically, the inductance differs from port to port. In consequence, those ports show poor symmetry. Hence, the performance of the isolator deteriorates. Furthermore, the capacitances between the adjacent central electrodes also differ from each other. This further deteriorates the symmetry of the ports.

SUMMARY OF THE INVENTION

It is therefore an object of the present invention to provide a high-performance, small-sized nonreciprocal circuit element which is free of the foregoing problems with the prior art techniques. This object is achieved by providing the central electrodes of the respective ports with different strip widths and/or strip spacings in such a way that the reactances of the central electrodes are uniform for every port. As a result, the insertion loss is reduced. Also, the isolation characteristics are improved.

According to a first aspect of the invention, a nonreciprocal circuit element may have a plurality of central electrodes arranged in mutually intersecting directions, a matching circuit connected to one end of each central electrode, the other end being grounded, the nonreciprocal circuit element being characterized in that respective strip widths of the central electrodes are individually selected for the individual ports. The strip widths may be unequal as appropriate for equalizing the reactances.

According to a second aspect of the invention, each of the central electrodes may be composed of plural strips, the respective strip spacings in the central electrodes being selected individually for the individual ports. The strip spacings may be unequal as appropriate for equalizing the reactances.

According to a third aspect of the invention, each of the central electrodes may be composed of plural strips, and respective strip widths and strip spacings in the central electrodes are selected individually for the individual ports. The strip widths and/or the strip spacings may be unequal as appropriate for equalizing the reactances.

According to the foregoing aspects of the invention, all or some of said central electrodes and said matching circuits, as well as input/output portions, may be formed in or on a multilayer substrate.

In the structure described above, the strip widths and/or the strip spacings in the central electrodes around the ports forming a nonreciprocal circuit element are separately determined and set for the individual ports. Thus, the reactances of the central electrodes can be made uniform for every port. When the central electrodes, the matching circuits, and so on are fabricated in or on a multilayer substrate, a further size reduction can be accomplished.

Other objects and features of the invention will appear in the course of the description thereof, which follows, with reference to the drawings.

DETAILED DESCRIPTION OF PREFERRED EMBODIMENTS

Figure 1:
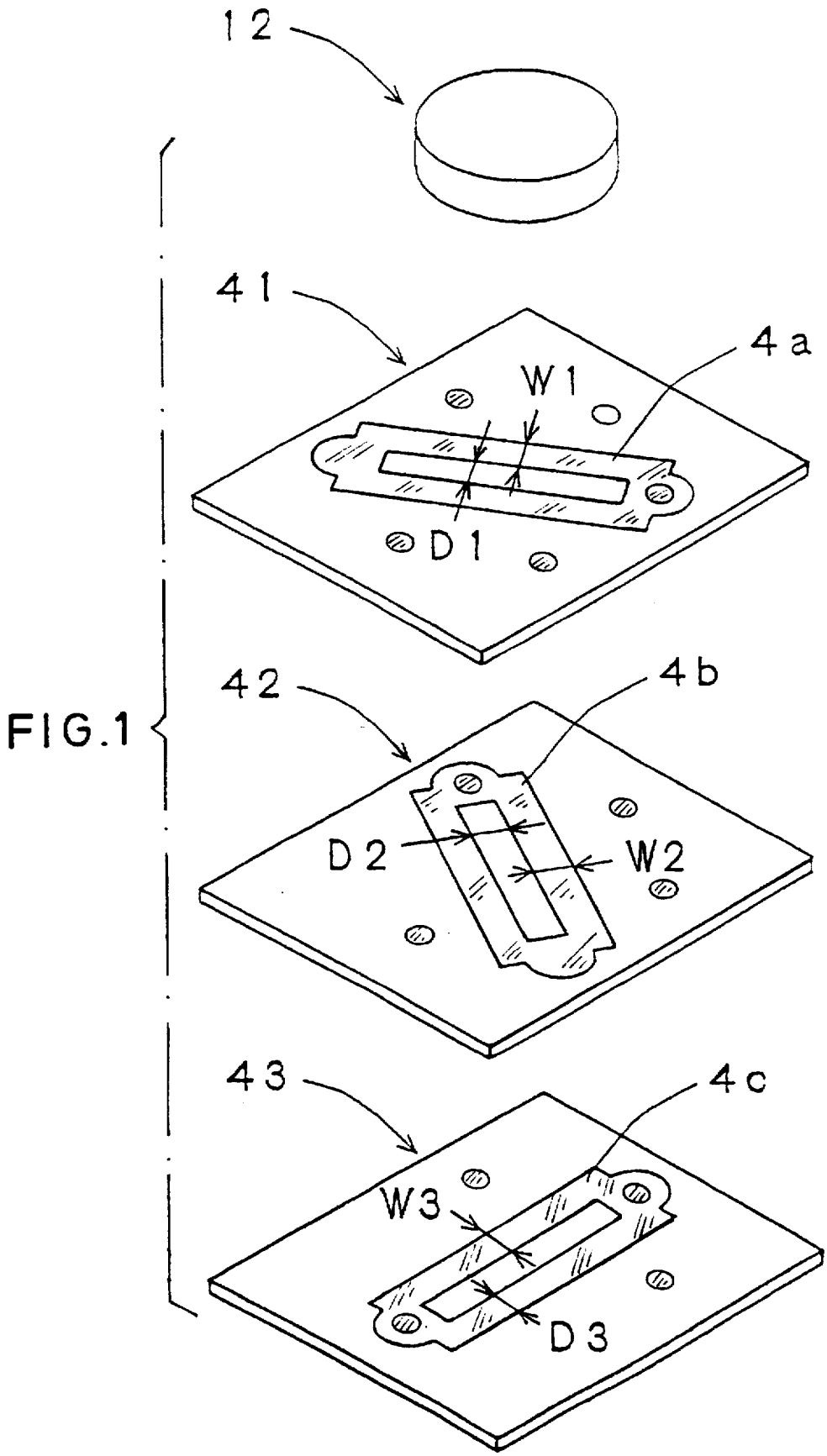
FIG. 1 is an exploded perspective view of an isolator forming a first example of the present invention.

The strip widths and/or the strip spacings in the central electrodes are set individually so as to make the reactance of the respective central electrode uniform for every port, as hereinafter described with reference to the accompanying drawings. In the drawings, like components are indicated by like reference numerals in the various figures.

The structure of main portions of an isolator forming a first example of the invention is shown in FIG. 1, which is an exploded perspective view showing the positional relations of the central electrodes included in a multilayer substrate with respect to a piece of ferrite. The isolator and the general structure of the multilayer substrate of this example are similar to their counterparts shown in FIGS. 4 and 5 and so they are not described here in more detail.

As shown in FIG. 1, sheets 41, 42, and 43 forming central electrode portions of the multilayer substrate of this example are provided with central electrodes 4*a*, 4*b*, and 4*c*, respectively, such that one central electrode is formed on each sheet. The sheets are placed on top of each other in such a way that the central electrodes 4*a*, 4*b*, and 4*c* make angles of 120 degrees with respect to each other. The single piece of ferrite 12 placed on the bottom wall of the lower yoke is positioned over the sheet 41. That is, the central electrodes 4*a*, 4*b*, and 4*c* are at different distances from the lower yoke which forms a grounding surface.

A central portion of each of the central electrodes 4*a*–4*c* is composed of two strips. As described previously, one end of each strip is connected to the corresponding port electrode, while the other end is connected to a grounding electrode.

It is assumed in this example that the strip spacings D1, D2 and D3 in the central electrodes 4*a*, 4*b*, and 4*c*, respectively, of this structure are the same. Given this condition, the manner in which the strip widths W1, W2, and W3 are set will be discussed first.

The reactance of each central electrode comprises the inductance of the strips of the central electrode, together with the capacitance between the strips of the adjacent central electrodes. Usually, the reactance due to the inductance is greater than the reactance due to the capacitance between the strips and so the inductance of the strips will be discussed first.

Generally, the inductance of a strip is in proportion to the characteristic impedance of the strip. The characteristic impedance of the strip decreases as it is located closer to ground. Also, the characteristic impedance decreases as the strip width increases. Accordingly, central electrodes located closer to ground, which would decrease their impedance, are made to have narrower strips, which correspondingly increases their impedance. Thus, the characteristic impedances of the ports are made uniform. As a result, the inductances of the ports can be made uniform.

Since the lower yoke and the upper yoke are connected to each other by soldering or the like, both yokes, as a whole, become grounding surfaces. However, in a case of such an isolator, generally, the grounding surface adjacent to the ferrite, that is, the grounding surface of the lower yoke adjacent to the ferrite, is the nearest to the central electrodes in the embodiments of this invention. The inductance of the central electrodes is defined, by the dimension between the central electrodes and the grounding surface of the lower yoke adjacent to the ferrite. Accordingly, when the inductance of the central electrodes is discussed in the embodiments of this invention, only the grounding surface of the lower yoke adjacent to the ferrite is considered as the ground.

Considered in this way, the strip widths W1, W2, and W3 of the central electrodes 4*a*, 4*b*, and 4*c* are set according to the relation $W1 \leqq W2 \leqq W3$. As a result, the inductances of the central electrodes around the ports can be rendered uniform.

Next, the capacitance between adjacent strips will be discussed. Since the above-described modifications of the strip widths of the central electrodes are only slight, the capacitances between the adjacent strips are affected only a little. The capacitance between the strips of the central electrode 4*a* is substantially equal to the capacitance between the strips of the central electrode 4*c*. The capacitance between the strips of the central electrode 4*b* is about twice as great as the capacitance between the strips of the central electrodes 4*a* and 4*c*. Therefore, the reactance due to the capacitance between the strips of the central electrode 4*b* is greater than the reactance due to the capacitance between the strips of the central electrodes 4*a* and 4*c*. In order to make uniform the reactance of the central electrodes 4*a*, 4*b*, and 4*c*, it is necessary that the inductance of the central electrode 4*b* be lower than the inductance of the central electrodes 4*a* and 4*c*. This requires that the strip width W2 of the central electrode 4*b* be widened to reduce the characteristic impedance of the central electrode 4*b*. Accordingly, when the apparatus is designed so as to take account of the capacitances between the strips, the strip widths W1, W2, and W3 of the central electrodes 4*a*, 4*b*, and 4*c*, respectively, may be set according to the relation $W1 \leqq W3 \leqq W2$.

When the strip widths are designed so as to take account of both the inductances of the central electrodes and the capacitances between the strips, the strip widths W1, W2, and W3 of the central electrodes 4*a*, 4*b*, and 4*c*, respectively, are set so as to satisfy either the relation $W1 \leqq W2 \leqq W3$ or the relation $W1 \leqq W3 \leqq W2$.

Next, again in the configuration shown in FIG. 1, it will be assumed that the strip widths W1, W2, and W3 of the central electrodes 4*a*, 4*b*, and 4*c*, respectively, are the same. Given this condition, the manner in which the strip spacings D1, D2, and D3 may be set will now be discussed.

Generally, the characteristic impedance of a central electrode decreases as the spacing between the strips of the central electrode is increased. Also, the characteristic impedance decreases as the central electrode is located closer to ground, as mentioned previously. Therefore, the characteristics of the ports can be made uniform by designing the central electrodes in such a way that the central electrodes located closer to ground have narrower strip spacings. This, in turn, makes uniform the inductances of the ports. That is, the strip spacings D1, D2, and D3 in the central electrodes 4*a*, 4*b*, and 4*c*, respectively, are set so as to satisfy the relation D1≦D2≦D3. In this way, the inductances of the central electrodes around the ports can be made uniform.

On the other hand, if the isolator is designed so as to take account of the capacitances between the strips, the strip spacings D1, D2, and D3 may also be set in such a manner that D1≦D3≦D2.

Thus, the strip spacings in the central electrodes may be set so as to satisfy either D1≦D2≦D3 or D1≦D3≦D2, depending on whether inductance or capacitance is considered.

Figure 2:
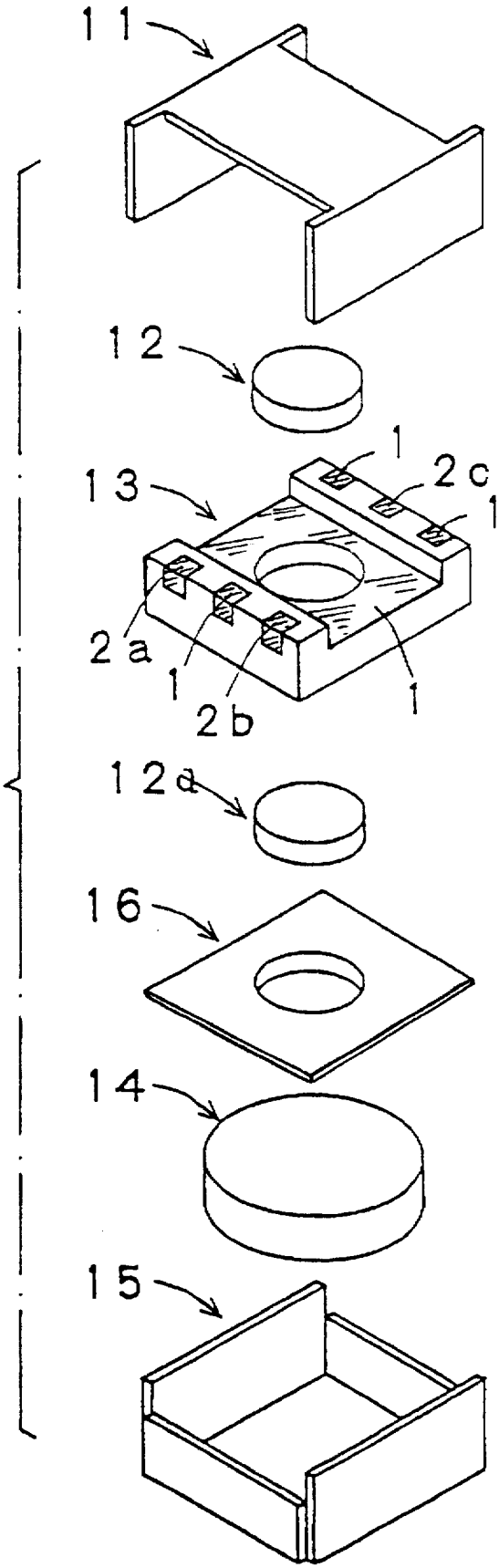
FIG. 2 is an exploded perspective view of an isolator forming a second example of the invention.
Figure 3:
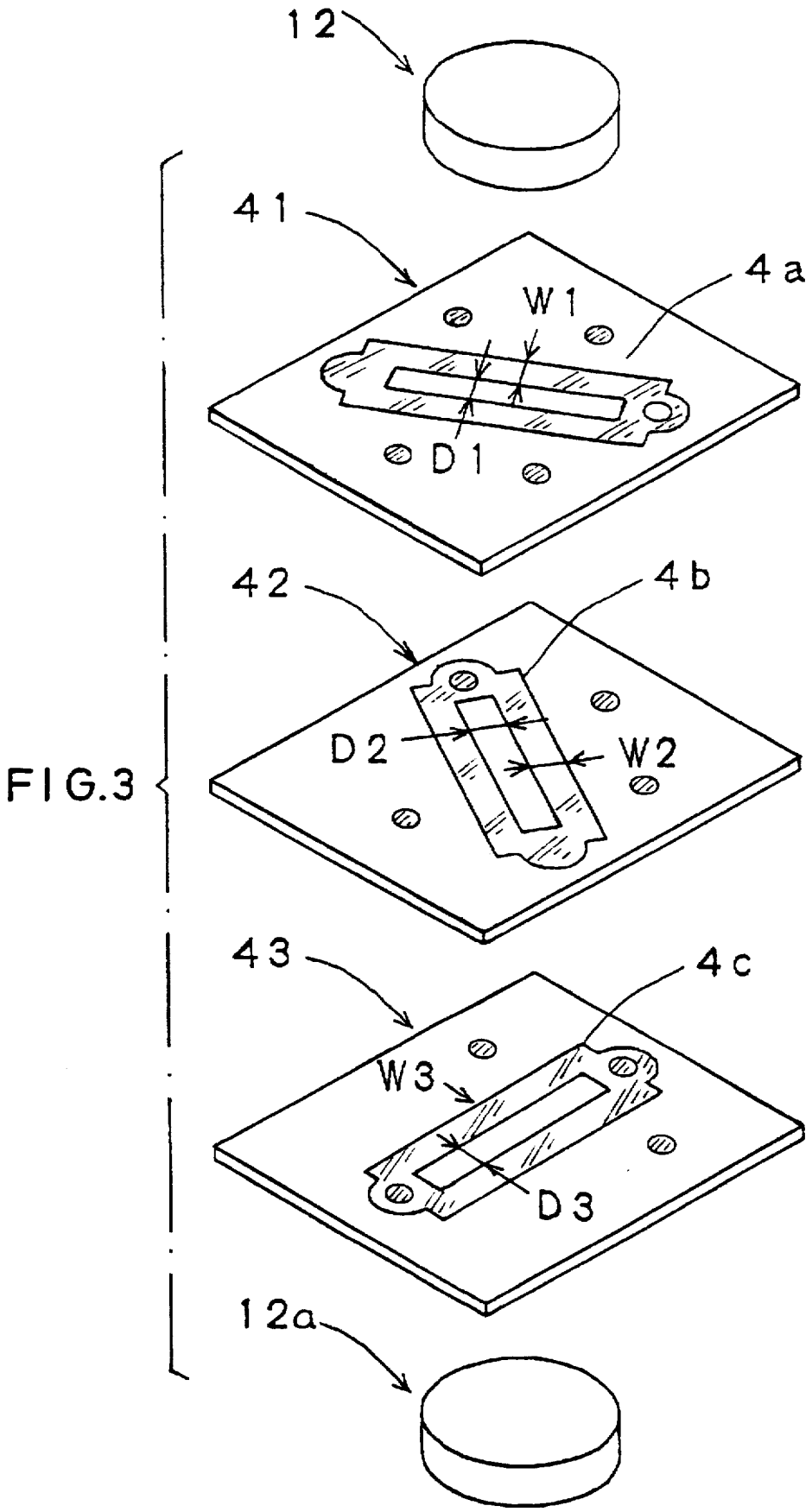
FIG. 3 is an exploded perspective view of portions of the isolator shown in FIG. 2.

The structure of an isolator forming a second example of the present invention is shown in FIGS. 2 and 3. FIG. 2 is an exploded perspective view showing the general structure of the isolator. FIG. 3 is an exploded perspective view showing the positional relation of the central electrodes of the multilayer substrate with respect to a pair of pieces of ferrite. The general structure of the multilayer substrate of the isolator of this example is similar to the structure already described in conjunction with FIG. 5 and so it is not described here.

Figure 4:
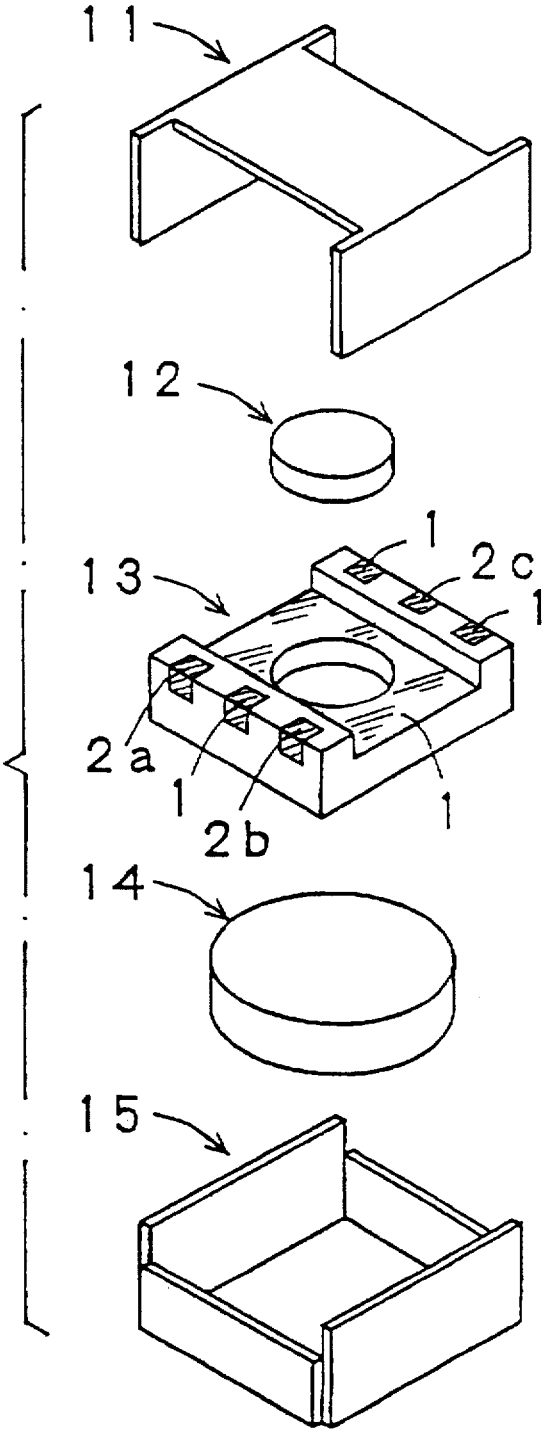
FIG.4 PRIOR ART
FIG. 4 is an exploded perspective view of a prior art isolator.
Figure 5:
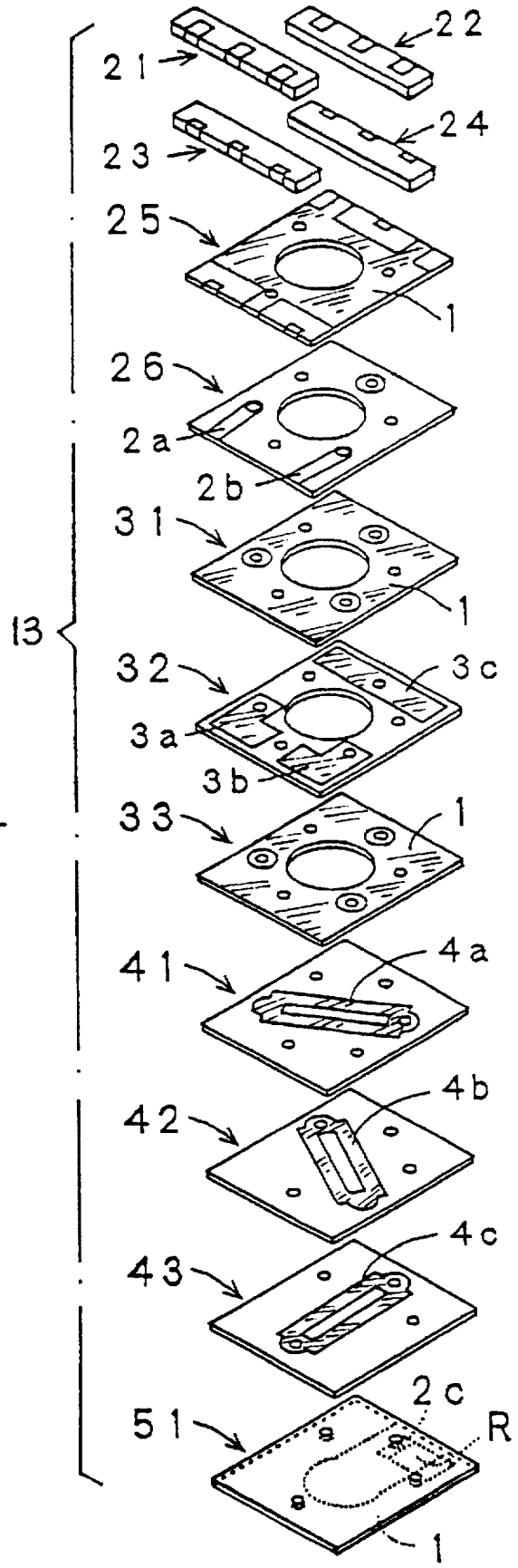
FIG. 5 PRIOR ART
FIG. 5 is an exploded perspective view of a multilayer substrate used in the prior art isolator of FIG. 4.

As shown in FIG. 2, the isolator of this example is similar to the isolator already described in connection with FIG. 4 except that a second ferrite piece, indicated by 12*a*, and a grounding plate 16, are disposed between a multilayer substrate 13 and a permanent magnet 14. In particular, as shown in FIG. 3, the two ferrite pieces 12 and 12*a* are placed above and below, respectively, the central electrodes of the isolator. In this structure, the grounding surfaces corresponding to the central electrodes 4*a*, 4*b*, and 4*c* are the lower yoke plate 11 and the grounding plate 16. Thus the distance between the upper grounding surface and the sheet 42 on which the central electrode 4*b* is formed is substantially equal to the distance between the lower grounding surface and the sheet 42.

In this structure, assuming the strip spacings D1, D2, and D3 are made uniform, in order to make the inductances of the central inductances uniform for every port, the strip widths W1, W2, and W3 should be set in such a way that W1=W3≦W2. Also, where the capacitances between the strips are taken into account, the inductance of the central electrode 4*b* may be set lower than the inductance of the central electrodes 4*a* and 4*c*. In order to make the reactances of the central electrodes be uniform for every port, the strip widths W1, W2, and W3 may be set in such a way that W1=W3≦W2.

Assuming the strip widths W1, W2, and W3 are rendered uniform, in order to make the reactances of the central electrodes uniform for every port, the strip spacings D1, D2, and D3 may be set in such a manner that D1=D3≦D2.

As has been described in connection with the first and second examples, the strip widths or strip spacings in the plural central electrodes are set separately for the individual ports to make the reactances of the central electrodes uniform around the ports. Therefore, the symmetry of the ports is improved. Also, the insertion loss can be reduced. Furthermore, the isolation characteristics can be enhanced.

In the above discussion, either the strip widths or the strip spacings are made uniform, and the other dimensions are then set to make the reactances uniform. The invention is not limited to this scheme, however. For example, both the strip widths and the strip spacings in the central electrodes may be separately set for the individual ports. In this case, a higher degree of freedom is obtained in designing the apparatus. Hence, the apparatus can be designed so as to obtain higher performance.

In the above examples, each central electrode is composed of two strips. The invention is not restricted to this structure, however. Each central electrode may be composed of one strip, or of three or more strips. Of course, when each central electrode consists of one strip, only the strip widths are set.

Furthermore, in the above examples, the isolator is designed with a terminal resistor connected to one port. The sheet 51 shown in FIG. 5 may be omitted, however. Alternatively, a circulator may be fabricated without connecting a terminal resistor R to the sheet 51.

Moreover, in the above examples, the central electrodes, matching circuits, and so on are fabricated in or on a multilayer substrate to reduce the size of the device. The invention is not limited to this structure. The invention is also applicable to a structure where each central electrode is made of a metallic conductor.

As described thus far, in the novel nonreciprocal circuit element, the strip widths or the strip spacings in the central electrodes around the ports in the circuit element are set separately for the individual ports so that the reactances of the central electrodes are made uniform for every port. Therefore, the symmetry of the ports is improved. Also, the insertion loss can be reduced. Furthermore, the isolation characteristics can be enhanced.

Moreover, the size can be reduced further by fabricating the central electrodes, matching circuits, and so on, in or on a multilayer substrate.

Accordingly, the invention provides a small-sized, high-performance nonreciprocal circuit element which produces less insertion loss and has improved isolation characteristics.

Although the present invention has been described in relation to particular embodiments thereof, many other variations and modifications and other uses will become apparent to those skilled in the art. It is preferred, therefore, that the present invention be limited not by the specific disclosure herein, but only by the appended claims.

What is claimed is:

1. A nonreciprocal circuit element comprising:

a plurality of central electrodes arranged in mutually intersecting directions, each of said central electrodes having a first end and a second end, at least two of said central electrodes having respective dimensions which are unequal;

a first grounding electrode disposed adjacent the central electrodes such that the respective distances from the central electrodes to the first grounding electrode are unequal;

a second grounding electrode disposed adjacent the central electrodes on a side thereof opposite the first grounding electrode, such that the respective distances from the central electrodes to the second grounding electrode are unequal;

first and second ferrite bodies disposed respectively between the central electrodes and the first and second grounding electrodes;

a permanent magnet disposed adjacent to the second grounding electrode on a side thereof opposite the second ferrite body; and the first ends of the central electrodes defining respective ports having substantially equal respective inductances, the second ends of the central electrodes being connected to one of the grounding electrodes;

wherein each said central electrode has a pair of strips, and at least two of the central electrodes have unequal strip spacings, the strip spacings of the central electrodes nearest the ferrite bodies being the narrowest and the strip spacing of the intermediate central electrode being the widest.

2. A method of providing substantially equal inductance in ports of a nonreciprocal circuit element, comprising the steps of:

a) assembling a nonreciprocal circuit element having:

a plurality of central electrodes arranged in mutually intersecting directions, each of said central electrodes having a first end and a second end, at least two of said central electrodes having respective dimensions which are unequal;

a first grounding electrode disposed adjacent the central electrodes such that the respective distances from the central electrodes to the first grounding electrode are unequal;

a second grounding electrode disposed adjacent the central electrodes on a side thereof opposite the first grounding electrode, such that the respective distances from the central electrodes to the second grounding electrode are unequal;

first and second ferrite bodies disposed respectively between the central electrodes and the first and second grounding electrodes;

a permanent magnet disposed adjacent to the second grounding electrode on a side thereof opposite the second ferrite body; and the first ends of the central electrodes defining respective ports, the second ends of the central electrodes being connected to one of the grounding electrodes;

b) forming at least two of the central electrodes such that at least one dimension thereof is unequal, thereby providing the ports of the nonreciprocal circuit element with substantially equal inductance;

wherein each said central electrode has a pair of strips, and at least two of the central electrodes have unequal strip spacings, the strip spacings of the central electrodes nearest the ferrite bodies being the narrowest and the strip spacing of the intermediate central electrode being the widest.

3. A method of providing substantially equal inductance in ports of a nonreciprocal circuit element, comprising the steps of:

a) assembling a nonreciprocal circuit element having:

a plurality of central electrodes arranged in mutually intersecting directions, each of said central electrodes having a first end and a second end;

a grounding electrode disposed adjacent the central electrodes such that the respective distances from the central electrodes to the grounding electrode are unequal;

a ferrite body disposed between the grounding electrode and the central electrodes;

a permanent magnet disposed adjacent to the central electrodes on a side thereof opposite the ferrite body; and the first ends of the central electrodes defining respective ports, the second ends of the central electrodes being connected to the grounding electrode; and b) forming at least two of the central electrodes such that at least one dimension thereof is unequal, thereby providing the ports of the nonreciprocal circuit element with substantially equal inductance;

wherein each said central electrode comprises a pair of strips, and the respective pairs of strips in at least two of said central electrodes are formed with unequal spacings, thereby providing the ports of the nonreciprocal circuit element with substantially equal inductance.

4. A method of providing substantially equal reactance in ports of a nonreciprocal circuit element, comprising the steps of:

a) assembling a nonreciprocal circuit element having:

a plurality of central electrodes arranged in mutually intersecting directions, each of said central electrodes having a first end and a second end, at least two of said central electrodes having respective dimensions which are unequal;

a grounding electrode disposed adjacent the central electrodes such that the respective distances from the central electrodes to the grounding electrode are unequal;

a ferrite body disposed between the grounding electrode and the central electrodes;

a permanent magnet disposed adjacent to the central electrodes on a side thereof opposite the ferrite body; and the first ends of the central electrodes defining respective ports, the second ends of the central electrodes being connected to the grounding electrode;

b) forming at least two of the central electrodes such that at least one dimension thereof is unequal, thereby providing the ports of the nonreciprocal circuit element with substantially equal reactance;

wherein each said central electrode has at least one strip, and the strips have unequal widths, the strip of the central electrode nearest the ferrite body being the narrowest and the strip of the central electrode farthest from the ferrite body being the widest.

5. A method of providing substantially equal reactance in ports of a nonreciprocal circuit element, comprising the steps of:

a) assembling a nonreciprocal circuit element having:

a plurality of central electrodes arranged in mutually intersecting directions, each of said central electrodes having a first end and a second end, at least two of said central electrodes having respective dimensions which are unequal;

a grounding electrode disposed adjacent the central electrodes such that the respective distances from the central electrodes to the grounding electrode are unequal;

a ferrite body disposed between the grounding electrode and the central electrodes;

a permanent magnet disposed adjacent to the central electrodes on a side thereof opposite the ferrite body; and the first ends of the central electrodes defining respective ports, the second ends of the central electrodes being connected to the grounding electrode;

b) forming at least two of the central electrodes such that at least one dimension thereof is unequal, thereby providing the ports of the nonreciprocal circuit element with substantially equal reactance;

wherein each said central electrode has at least one strip, and the strips of the central electrodes have unequal widths, the strip of the central electrode nearest the ferrite body being the narrowest and the strip of the intermediate central electrode being the widest.

6. A method of providing substantially equal reactance in ports of a nonreciprocal circuit element, comprising the steps of:

a) assembling a nonreciprocal circuit element having:

a plurality of central electrodes arranged in mutually intersecting directions, each of said central electrodes having a first end and a second end, at least two of said central electrodes having respective dimensions which are unequal;

a grounding electrode disposed adjacent the central electrodes such that the respective distances from the central electrodes to the grounding electrode are unequal;

a ferrite body disposed between the grounding electrode and the central electrodes;

a permanent magnet disposed adjacent to the central electrodes on a side thereof opposite the ferrite body; and the first ends of the central electrodes defining respective ports, the second ends of the central electrodes being connected to the grounding electrode;

b) forming at least two of the central electrodes such that at least one dimension thereof is unequal, thereby providing the ports of the nonreciprocal circuit element with substantially equal reactance;

wherein each said central electrode has a pair of strips, and at least two of the central electrodes have unequal strip spacings, the strip spacing of the central electrode nearest the ferrite body being the narrowest and the strip spacing of the central electrode farthest from the ferrite body being the widest.

7. A method of providing substantially equal reactance in ports of a nonreciprocal circuit element, comprising the steps of:

a) assembling a nonreciprocal circuit element having:

a plurality of central electrodes arranged in mutually intersecting directions, each of said central electrodes having a first end and a second end, at least two of said central electrodes having respective dimensions which are unequal;

a grounding electrode disposed adjacent the central electrodes such that the respective distances from the central electrodes to the grounding electrode are unequal;

a ferrite body disposed between the grounding electrode and the central electrodes;

a permanent magnet disposed adjacent to the central electrodes on a side thereof opposite the ferrite body; and the first ends of the central electrodes defining respective ports, the second ends of the central electrodes being connected to the grounding electrode;

b) forming at least two of the central electrodes such that at least one dimension thereof is unequal, thereby providing the ports of the nonreciprocal circuit element with substantially equal reactance;

wherein each said central electrode has a pair of strips, and at least two of the central electrodes have unequal strip spacings, the strip spacing of the central electrode nearest the ferrite body being the narrowest and the strip spacing of the intermediate central electrode being the widest.

8. A method of providing substantially equal inductance in ports of a nonreciprocal circuit element, comprising the steps of:

a) assembling a nonreciprocal circuit element having:

a plurality of central electrodes arranged in mutually intersecting directions, each of said central electrodes having a first end and a second end, at least two of said central electrodes having respective dimensions which are unequal;

a grounding electrode disposed adjacent the central electrodes such that the respective distances from the central electrodes to the grounding electrode are unequal;

a ferrite body disposed between the grounding electrode and the central electrodes;

a permanent magnet disposed adjacent to the central electrodes on a side thereof opposite the ferrite body; and the first ends of the central electrodes defining respective ports, the second ends of the central electrodes being connected to the grounding electrode;

b) forming at least two of the central electrodes such that at least one dimension thereof is unequal, thereby providing the ports of the nonreciprocal circuit element with substantially equal inductance;

wherein each said central electrode has at least one strip, and the strips have unequal widths, the strip of the central electrode nearest the ferrite body being the narrowest and the strip of the central electrode farthest from the ferrite body being the widest.

9. A method of providing substantially equal inductance in ports of a nonreciprocal circuit element, comprising the steps of:

a) assembling a nonreciprocal circuit element having:

a plurality of central electrodes arranged in mutually intersecting directions, each of said central electrodes having a first end and a second end, at least two of said central electrodes having respective dimensions which are unequal;

a grounding electrode disposed adjacent the central electrodes such that the respective distances from the central electrodes to the grounding electrode are unequal;

a ferrite body disposed between the grounding electrode and the central electrodes;

a permanent magnet disposed adjacent to the central electrodes on a side thereof opposite the ferrite body; and the first ends of the central electrodes defining respective ports, the second ends of the central electrodes being connected to the grounding electrode;

b) forming at least two of the central electrodes such that at least one dimension thereof is unequal, thereby providing the ports of the nonreciprocal circuit element with substantially equal inductance;

wherein each said central electrode has a pair of strips, and at least two of the central electrodes have unequal strip spacings, the strip spacing of the central electrode nearest the ferrite body being the narrowest and the strip spacing of the central electrode farthest from the ferrite body being the widest.

10. A method of providing substantially equal reactance in ports of a nonreciprocal circuit element comprising the steps of:

a) assembling a nonreciprocal circuit element having:

a plurality of central electrodes arranged in mutually intersecting directions, each of said central electrodes having a first end and a second end, at least two of said central electrodes having respective dimensions which are unequal;

a first grounding electrode disposed adjacent the central electrodes such that the respective distances from the central electrodes to the first grounding electrode are unequal;

a second grounding electrode disposed adjacent the central electrodes on a side thereof opposite the first grounding electrode, such that the respective distances from the central electrodes to the second grounding electrode are unequal;

first and second ferrite bodies disposed respectively between the central electrodes and the first and second grounding electrodes;

a permanent magnet disposed adjacent to the second grounding electrode on a side thereof opposite the second ferrite body; and the first ends of the central electrodes defining respective ports, the second ends of the central electrodes being connected to one of the grounding electrodes;

b) forming at least two of the central electrodes such that at least one dimension thereof is unequal, thereby providing the ports of the nonreciprocal circuit element with substantially equal reactance;

wherein each said central electrode has at least one strip, and the strips have unequal widths, the strips of the central electrodes nearest the ferrite bodies being the narrowest and the strip of the intermediate central electrode being the widest.

11. A method of providing substantially equal reactance in ports of a nonreciprocal circuit element, comprising the steps of:

a) assembling a nonreciprocal circuit element having:

a plurality of central electrodes arranged in mutually intersecting directions, each of said central electrodes having a first end and a second end, at least two of said central electrodes having respective dimensions which are unequal;

a first grounding electrode disposed adjacent the central electrodes such that the respective distances from the central electrodes to the first grounding electrode are unequal;

a second grounding electrode disposed adjacent the central electrodes on a side thereof opposite the first grounding electrode, such that the respective distances from the central electrodes to the second grounding electrode are unequal;

first and second ferrite bodies disposed respectively between the central electrodes and the first and second grounding electrodes;

a permanent magnet disposed adjacent to the second grounding electrode on a side thereof opposite the second ferrite body; and the first ends of the central electrodes defining respective ports, the second ends of the central electrodes being connected to one of the grounding electrodes;

b) forming at least two of the central electrodes such that at least one dimension thereof is unequal, thereby providing the ports of the nonreciprocal circuit element with substantially equal reactance;

wherein each said central electrode has a pair of strips, and at least two of the central electrodes have unequal strip spacings, the strip spacings of the central electrodes nearest the ferrite bodies being the narrowest and the strip spacing of the intermediate central electrode being the widest.

12. A method of providing substantially equal inductance in ports of a nonreciprocal circuit element, comprising the steps of:

a) assembling a nonreciprocal circuit element having:

a plurality of central electrodes arranged in mutually intersecting directions, each of said central electrodes having a first end and a second end, at least two of said central electrodes having respective dimensions which are unequal;

a first grounding electrode disposed adjacent the central electrodes such that the respective distances from the central electrodes to the first grounding electrode are unequal;

a second grounding electrode disposed adjacent the central electrodes on a side thereof opposite the first grounding electrode, such that the respective distances from the central electrodes to the second grounding electrode are unequal;

first and second ferrite bodies disposed respectively between the central electrodes and the first and second grounding electrodes;

a permanent magnet disposed adjacent to the second grounding electrode on a side thereof opposite the second ferrite body; and the first ends of the central electrodes defining respective ports, the second ends of the central electrodes being connected to one of the grounding electrodes;

b) forming at least two of the central electrodes such that at least one dimension thereof is unequal, thereby providing the ports of the nonreciprocal circuit element with substantially equal inductance;

wherein each said central electrode has at least one strip, and the strips have unequal widths, the strips of the central electrodes nearest the ferrite bodies being the narrowest and the strip of the intermediate central electrode being the widest.

* * * * *